US005927262A

United States Patent [19]

Bixler

[11] Patent Number: 5,927,262

[45] Date of Patent: Jul. 27, 1999

[54] BALL CONTROL DEVICE FOR PITCHBACK MACHINES

[75] Inventor: Dickie R. Bixler, Enid, Okla.

[73] Assignee: World Patent Development Corporation, Enid, Okla.

[21] Appl. No.: 08/998,950

[22] Filed: Dec. 29, 1997

[51] Int. Cl.[6] ..... F41B 3/00

[52] U.S. Cl. ..... 124/81; 124/6

[58] Field of Search ..... 124/6, 7, 81

[56] References Cited

U.S. PATENT DOCUMENTS

| | | | |
|---|---|---|---|
| 2,655,908 | 10/1953 | Calleo | 124/7 |
| 3,915,143 | 10/1975 | Waller . | |
| 4,197,827 | 4/1980 | Smith | 124/78 |
| 4,323,047 | 4/1982 | McIntosh et al. | 124/1 |
| 4,442,823 | 4/1984 | Floyd et al. | 124/78 |
| 4,632,088 | 12/1986 | Bruce | 124/78 |
| 4,655,190 | 4/1987 | Harris | 124/78 |
| 4,823,763 | 4/1989 | Ponza | 124/78 |
| 5,064,194 | 11/1991 | Bixler et al. . | |
| 5,121,735 | 6/1992 | Hancock | 124/7 |
| 5,265,583 | 11/1993 | Otto | 124/81 |
| 5,359,986 | 11/1994 | Magrath et al. | 124/78 |
| 5,413,085 | 5/1995 | Kraeft | 124/81 |
| 5,464,208 | 11/1995 | Pierce . | |
| 5,533,722 | 7/1996 | Lu . | |
| 5,599,017 | 2/1997 | Bixler et al. | 473/436 |
| 5,660,386 | 8/1997 | Krieger | 124/7 |

*Primary Examiner*—John A. Ricci
*Attorney, Agent, or Firm*—Fellers, Snider, Blankenship, Bailey & Tippens, P.C.

[57] ABSTRACT

A ball control device for combination with a ball tossing machine of the type having a rotating throw arm for propelling a ball. The ball control device has a proximal end for mounting to the throw arm and a terminal end. Between the proximal and terminal ends lies a slightly arcuate, open, longitudinal channel or trough that receives and controls a ball as the throw arm rotates. The ball advances along the surface of the channel until, upon rotation to a break over point, the ball is propelled from the terminal end of the device. To impart a curve, spin or drop to the ball, a spin actuator is mounted at the terminal end of the device. A surface portion of the ball, as it reaches the terminal end of the device (at the break over point), is momentarily engaged by the spin actuator, which, when the ball is propelled, induces a spin upon the ball in a manner that mimics the action of a pitcher's grip upon the ball.

8 Claims, 3 Drawing Sheets

BALL CONTROL DEVICE FOR PITCHBACK MACHINES

BACKGROUND OF THE INVENTION

1. Field of Invention

The present invention relates generally to devices for use in practicing the fundamentals of ball games, and, more specifically, to a ball control device for use in connection with ball tossing machines of the type having a rotating throw arm for propelling a ball.

2. Background

Heretofore, various devices and machines have been invented for aiding the development of skills necessary for playing ball games successfully. For many years ball pitching machines have been used to simulate pitched or batted baseballs and softballs, tennis ball serves or racket returns of tennis balls. These machines have generally utilized springs, compressed gasses, elastic members, or rotating arms to impart a propelling force to a ball.

Two such devices include Applicant's Apparatus for Use in Practicing Pitching of Baseballs, disclosed and claimed in U.S. Pat. No. 5,064,194, and Applicant's Baseball Target and Projector Apparatus, disclosed and claimed in U.S. Pat. No. 5,599,017. Both aforementioned patents are hereby incorporated by reference.

The machine of the '194 patent enables the user to improve pitching accuracy by receiving pitched balls and indicating whether the balls were delivered within a strike zone. The apparatus has a vertical backboard with a rectangular opening therethrough, four trapezoidal shaped wings pivotally secured to the backboard that serve to form an opening defining a strike zone, electrical contacts activated as each trapezoidal wing is pivoted when struck by a baseball, and electrical indicators for signaling when a baseball strikes one of the trapezoidal wings to indicate that the baseball has been pitched high, low, inside or outside of the strike zone.

In one of its preferred embodiments, the prior apparatus includes a ball tossing machine, commonly called a pitchback machine, configured to return balls that have passed through the strike zone to the pitcher. A pitched ball passing through the strike zone opening enters a catcher box. From there the ball moves via gravity flow downward to the pitchback machine. The pitchback machine picks up the ball and throws it through a pitchback opening.

A pitchback machine may also be used to throw a baseball to a batter or to propel a baseball toward a fielder. While suitable for improving pitching accuracy, the above described apparatus, and more specifically the configuration of the catcher box and the pitchback machine, was not adequate to propel a high volume of balls to a practicing batter or fielder.

The machine of the '017 patent advances the art in that it may be used to practice pitching, hitting and fielding because of its ability to competently manage a high volume of baseballs. In its preferred embodiment, shown partially in FIG. 2 of the '017 patent, a pitchback machine is provided to propel baseballs from the apparatus.

The pitchback machines utilized in Applicant's prior devices are of the type having a 360 degree rotating throw arm. As it rotates, the throw arm receives a ball from a ball supply or reservoir. The speed of rotation increases as the throw arm reaches a break over point whereupon the ball is released toward its target. Such machines are well-known and frequently employed in pitching or batting practice devices. The pitchback machine generally comprises a number of pulleys, gears, cables and springs that work in concert to whip the throw arm to impart high velocities upon the ball. Pitchback machines are normally driven by a pitchback machine motor. The speed at which a baseball is propelled from a pitchback machine might also be adjustable by the user. Many different arrangements of structural components may comprise a rotating throw arm type pitchback machine.

One difficulty generally encountered with ball tossing machines is the problem of providing different types of pitches, and, particularly, inducing a spin on the propelled ball that results in a curved trajectory. It is oftentimes desirable to throw a curving ball, especially in connection with baseball batting practice where true game condition pitching is difficult to achieve in a practice setting. Heretofore, abrasive or friction devices, such as brake shoes, sand paper, and other surfaces, have been used to provide friction to a passing ball in order to induce a spin.

U.S. Pat. No. 5,265,583 is an example of a friction type device. The device is connected to a ball ejector barrel on a tennis ball ejector machine to impart a top spin to ejected tennis balls. The device includes a paddle assembly which is pivotable to contact and impart a top spin motion to a tennis ball that has been ejected from the ball ejector barrel. The contact surface of the paddle assembly is constructed of an abrasive type material.

Another device that attaches to a ball ejector barrel is described in U.S. Pat. No. 3,915,143. The outer end portion of the barrel carries what is called a curve control mechanism for applying various curves or other actions to baseballs leaving the barrel. The curve control mechanism includes a number of fingers, aligned in pairs, that spread apart and flex as a ball passes by them. The resistance applied by the fingers to the ball imparts a spin thereto.

Others have approached the problem of inducing a spin on propelled balls by actuating the spin within a guide chute through which the propelled ball passes. U.S. Pat. No. 4,323,047 discloses an automatic ball pitching machine that features a rotating flywheel which propels a ball into an upper guide chute in which is disposed a rubber pad to provide a constriction. A backspin is caused by the propelled ball passing through the constriction.

As disclosed in U.S. Pat. No. 5,413,085, a guide chute is placed in front of a ball pitching machine, and, if a curve ball is desired, a cantilevered resilient strap is inserted inside the guide chute in a position to engage the propelled ball. The strap conforms to the ball surface shape and induces a ball spin, resulting in a curve ball trajectory.

Though an object of the earlier devices was to provide straight or induced curve balls propelled in a similar manner as a human pitcher, such has not been achieved to the extent that the spin is imparted to the ball after it has been propelled. Devices used to contact the ball after it has been propelled from an ejector barrel and, similarly, those that affect the propelled ball as it passes through a guide chute, act to induce a spin only after the ball has received its propelling force. This is in contrast to the mechanism of actual human pitching, where the ball is held stationary in the hand as the arm is put through the throwing motion and spin is imparted to the ball by the contact of the fingers as the ball leaves the hand. In fact, prior devices, operating off the end of ejector barrels or in connection with guide chutes, are not adaptable to the ball tossing machines that best mimic the throwing motion of the human, i.e. the type having a rotating throw arm for propelling the ball.

It is thus an object of the present invention to provide a device for inducing spin upon a ball in a manner that mimics a human throw rather than inducing a spin after the ball has been propelled.

It is a further object of the invention that for use in combination with a ball tossing machine of the type having a rotating throw arm for propelling a ball.

It is another object of the invention that the device be compact and readily attachable to the rotating throw arm of existing pitching machines.

It is a still further object of the invention that the device be capable of providing a variety of spin trajectories or pitches, such as curve balls, sliders, sinkers or drop pitches, rising balls, etc.

It is an additional object of the invention that neither the device nor the ball tossing machine need be reset or adjusted between tosses in order to receive a variety of pitches.

SUMMARY OF THE INVENTION

These and other objects and advantages are achieved with the present invention, which encompasses a ball control device to be used in connection with ball tossing machines of the type having a rotating throw arm for propelling a ball, whether it be a baseball, softball, tennis ball, or other ball. The ball control device has a proximal end adapted for mounting to the throw arm of the pitchback machine and a terminal end. Between the proximal and terminal ends lies a slightly arcuate, open, longitudinal channel or trough that receives and controls a ball as the throw arm rotates. The ball advances along the surface of the channel until, upon rotation to a break over point (release point), the ball is propelled from the terminal end of the device.

To impart a curve, spin or drop to the ball, a spin actuator is mounted at the terminal end of the device. A surface portion of the ball, as it reaches the terminal end of the longitudinal channel (at the break over point), is momentarily engaged by the spin actuator, which, when the ball is propelled, induces a spin upon the ball in a manner that mimics the action of a human grip.

The spin actuator comprises a free-spinning roller wheel mounted on an axle and supported in a fixed, ball contacting position at the terminal end of the device by a roller support plate. The surface of the roller wheel has a number of raised, transverse ridges to aid in gripping a surface portion of the ball. The ball surface contacts the roller wheel when the throw arm reaches the break over point but prior to the ball being propelled from the device. Different spins are imparted on successive balls due to the varied position of the ball seams as the roller wheel is contacted. The ridges, with corresponding lands or valleys therebetween, engage the ball surface as the ball is propelled from the device, much as a human pitcher's fingers contact the ball as it leaves the hand.

When in operative relation with the throw arm, the device receives a ball, and, as the throw arm rotates, the ball rolls along the channel surface on a standard line of travel toward the terminal end of the device, whereupon the ball engages the spin actuator and is subsequently propelled. In accordance with another aspect of the invention, a means for partially obstructing the standard line of travel is mounted along the channel surface. The obstruction is not so severe as to completely impede the travel of the ball to the terminal end of the device, but is sufficient to tip the ball as it advances along the standard line of travel, causing the ball to thereafter wobble as it rolls further along the channel and to engage the spin actuator on a non-standard line of travel. In this way the ball contacts the spin actuator at different positions and angles to provide additional pitch variety. In the preferred embodiment, the means for partially obstructing the standard line of travel comprises an oblong obstacle positioned at one side of the channel.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention. As will be realized, the invention is capable of modifications in various obvious respects, all without departing from the scope of the invention. Accordingly, the description should be regarded as illustrative in nature and not as restrictive.

DETAILED DESCRIPTION OF THE PREFERRED EMBODIMENT

Before explaining the present invention in detail, it is important to understand that the invention is not limited in its application to the details of construction and the steps illustrated herein. The invention is capable of other embodiments and of being practiced or carried out in a variety of ways. It is to be understood that the phraseology and terminology employed herein is for the purpose of description and not of limitation.

Figure 1:
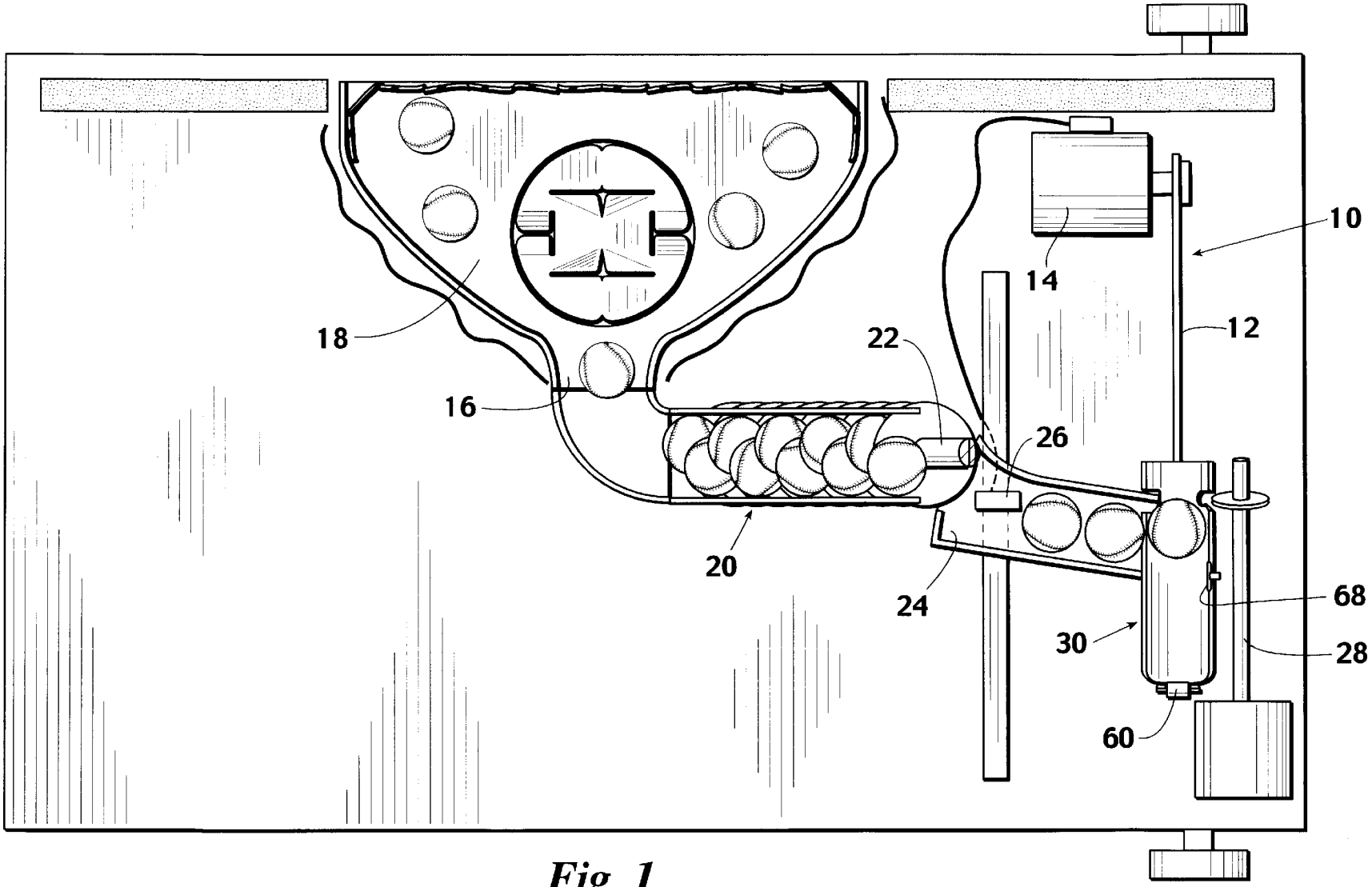
FIG. 1 is a top plan view of a ball tossing machine of the type having a rotating throw arm with the preferred ball control device mounted thereto.

Referring now to FIG. 1, there are shown certain operative elements of a ball tossing machine of the type having a rotating throw arm with the preferred ball control device mounted thereto. This particular machine is disclosed in detail in U.S. Pat. No. 5,599,017 and is illustrative, but not limiting, of the type of ball tossing, or pitchback, machine to which the present invention is directed.

In the figure, the pitchback machine is generally indicated by the reference numeral 10. Such machines are well-known and frequently employed in pitching or batting practice equipment and generally comprise a throw arm 12 and pitchback machine motor 14 or other means of imparting a rotating force to the throw arm 12. The throw arm 12 picks up and propels a ball while the pitchback machine motor 14 drives the throw arm 12. Many different arrangements of structural components comprising a pitchback machine are compatible with the present invention, so long as a rotating throw arm is used to propel the ball, and the pitchback machines contemplated for use with the present invention may accommodate regulation sized baseballs, softballs, tennis balls or other game balls.

In connection with the illustrative ball tossing machine, an outlet path 16 runs from a holding tray 18 to the lower end of an auger means 20. Upon rotation of the auger shaft 22 balls are moved upward toward a pick up chute 24. The balls exit the auger means 20 one at a time and roll onto the forward end of the pick up chute 24. The pick up chute 24 is provided with a shut off switch 26 which controls the flow of balls. The pick up chute 24 is downwardly inclined so that when the shut off switch 26 is engaged a ball will roll toward the terminal end of pick up chute 24 and come to rest against an adjustable ball stop 28. The ball stop 28 is positioned at a distance from the terminal end of the pick up chute 24 sufficient for presenting the ball to the rotating throw arm 12 of the pitchback machine 10. The only adjustment that need be made to convert the illustrated apparatus to and from various ball modes is to adjust the ball stop 28 so that throw arm 12 is properly positioned for the size ball being used.

Figure 3:
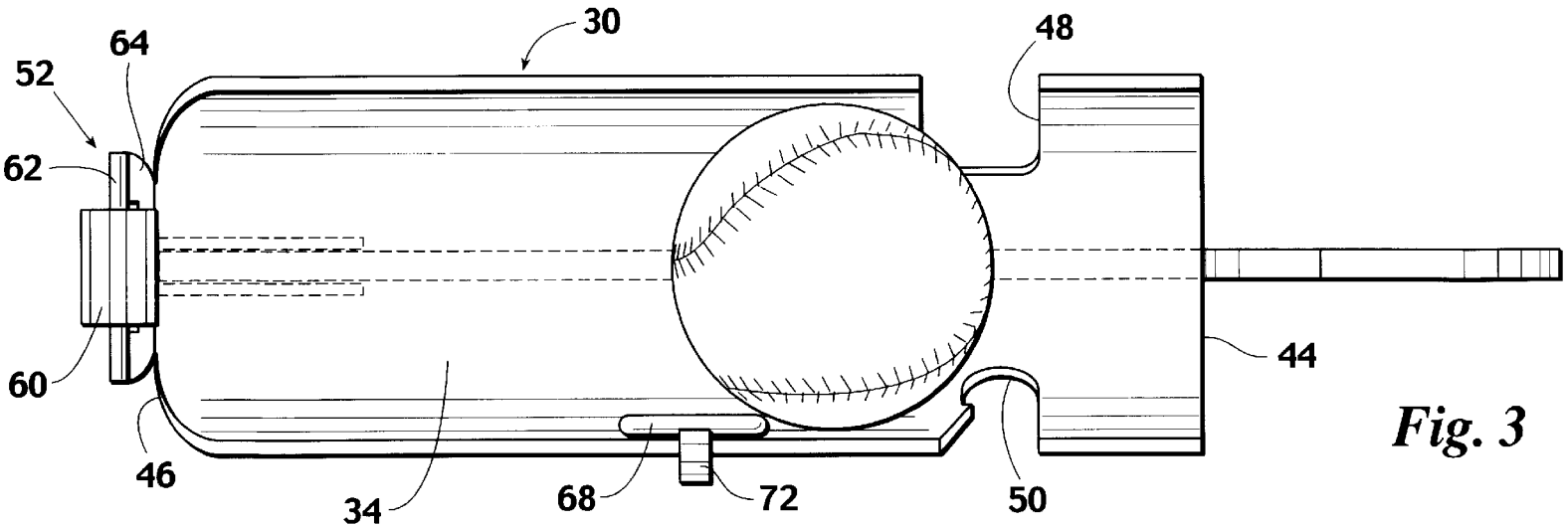
FIG. 3 is a top view of the preferred ball control device.
Figure 2:
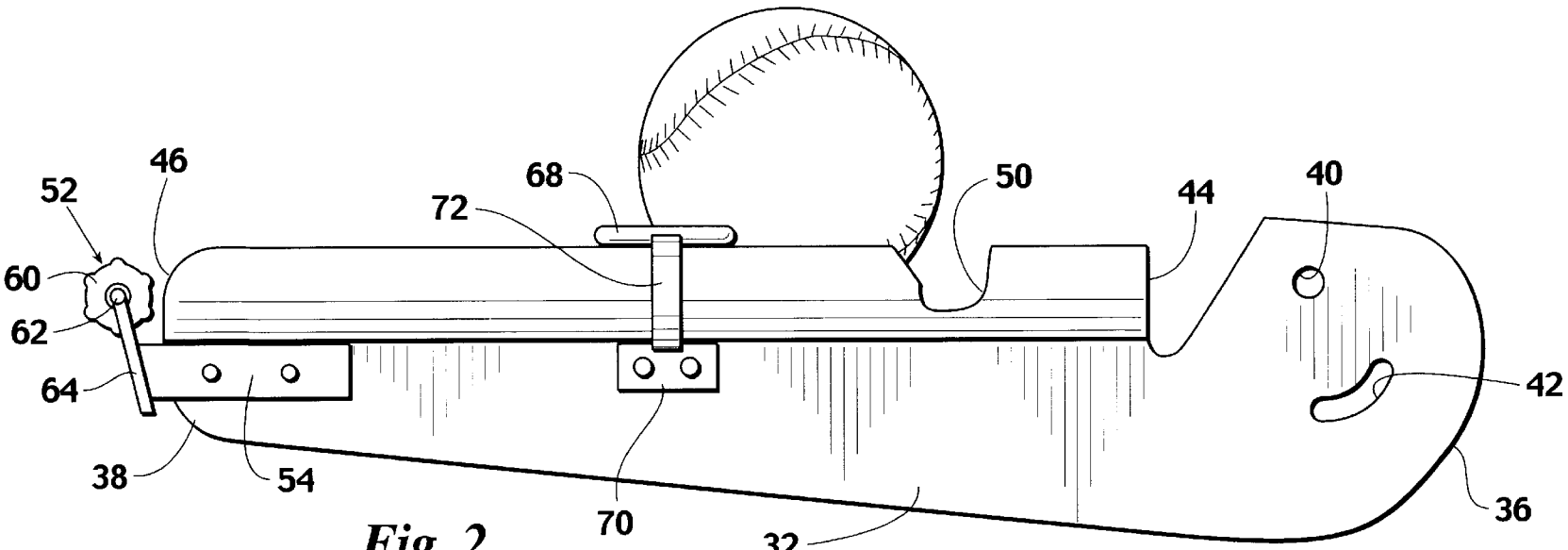
FIG. 2 is a side elevational view of the preferred ball control device.

Shown in FIG. 1 mounted to the throw arm 12, and in better detail in FIGS. 2 and 3, is the inventive ball control device 30. The preferred device 30 has a certain rib or spine 32 running along its longitudinal axis and a slightly arcuate, open longitudinal channel or trough 34 centered thereabove.

The central rib has a proximal end 36 and a terminal end 38, which correspond to the proximal and terminal ends of the device 30 itself. The proximal end 36 of the central rib 32 is adapted for mounting to the throw arm 12. A number of different permanent or adjustable mounts or methods of affixation can be used, but shown in FIG. 2 is a mounting hole 40 along with a mounting slot 42. The mounting hole 40 and mounting slot 42 may be affixed to corresponding mounting structure (not shown) on the throw arm 12 such as by bolt and wing nut assemblies or other mounting fixtures. By using mounting hole 40 as a pivot point and mounting slot 42 as an adjustable mount, the angular orientation of the device 30 in relation to the throw arm 12 may be adjusted to accommodate desired target areas or to achieve varying release points.

The longitudinal channel 34 is centered above the central rib 32 and is affixed thereto such as by welding. The channel 34 is slightly arcuate and is open in the sense that it is not a fully enclosed chute or passageway. The proximal end 44 of the channel 34 is located forward of the proximal end 36 of the central rib 32 and its mounting structure. The terminal end 46 of the channel 34 coincides with the terminal end 38 of the central rib 32 and the device 30 itself. Thus, the proximal end 36 of the central rib 32 may be considered as the proximal end of device 30, while the terminal end of the device 30 corresponds to both the terminal end 38 of the central rib 32 and the terminal end 46 of the channel 34.

The channel 34 as illustrated has two notches 48, 50 cut therein to provide clearance for structure of the ball tossing machine. The notches 48, 50 do not interfere with the operation of the device 30 but are merely for convenience purposes. Notch 48 is used to clear one edge of the illustrated pick up chute 24, while notch 50 is juxtaposed to the donut of the ball stop 28.

The device 30 is mounted to the throw arm 12 utilizing the mounting hole 40 and mounting slot 24. When in operative relation, the device 30 receives a ball in a receiving area, corresponding to a surface portion of the channel 34 toward its proximal end 44, and as the throw arm 12 rotates, the ball advances by rolling along the channel 34 where, upon reaching the terminal end at the break over point, the ball is propelled.

Figure 5:
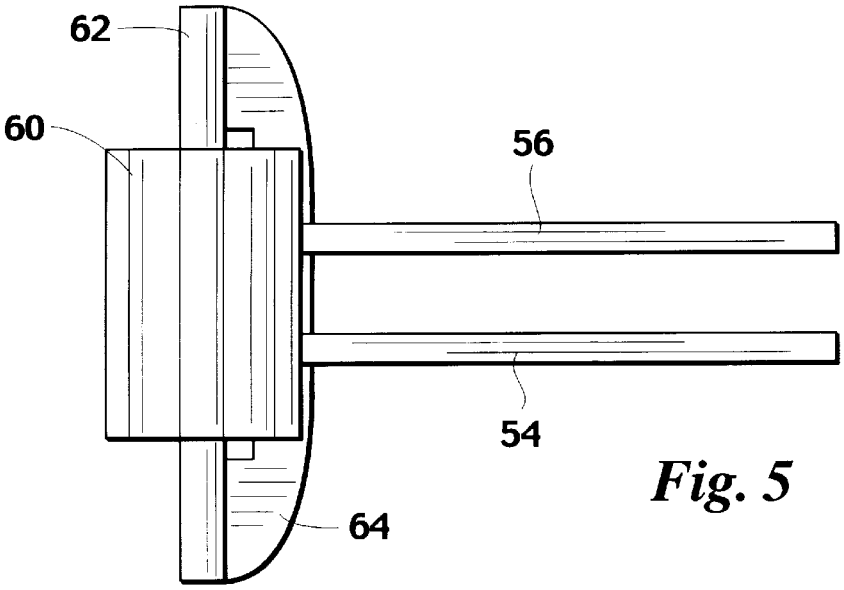
FIG. 5 is a top view of the preferred spin actuator.
Figure 4:
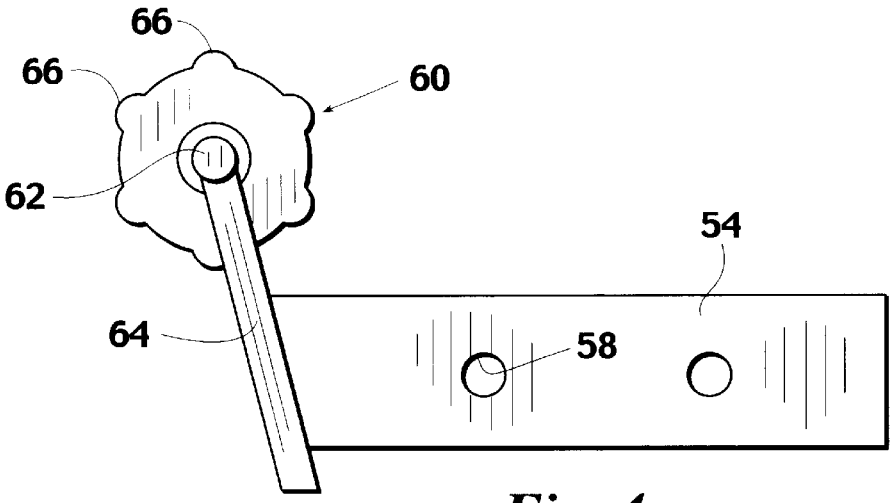
FIG. 4 is a side elevational view of the preferred spin actuator.
Figure 6:
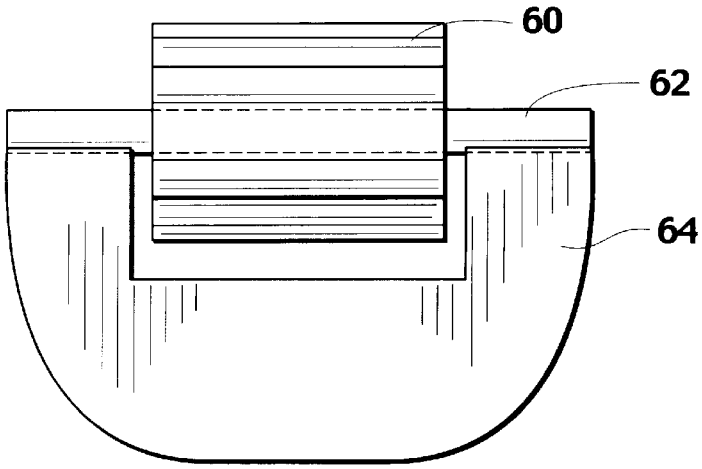
FIG. 6 is an end view of the preferred spin actuator.

A spin actuator, generally indicated by the reference numeral 52, is mounted at the terminal end of the device 30. The spin actuator 52 is shown in further detail in FIGS. 4–6. The function of the spin actuator 52 is to momentarily engage a surface portion of the ball prior to the ball being propelled, thereby imparting a spin to the ball as it is propelled from the device 30 in a manner that mimics the action of a human grip, i.e. by contacting the ball as it is being propelled akin to the action of a pitcher's fingers. The spin actuator 52 is mounted to the proximal end of the device 30 by two side braces 54, 56 which attached to either side of the central rib 32 such as by the use of mounting holes 58 and corresponding rivets or bolts or as by welding or other attachment. The preferred spin actuator is a free-spinning roller wheel 60 which is mounted on an axle 62 and is supported in a fixed, ball contacting position by a roller support plate 64. The surface of the roller wheel 60 is provided with a plurality of transverse ridges 66 to aid the roller wheel 60 in gripping a surface portion of the ball. Thus, as a ball reaches the terminal end of the channel 34 a surface portion of the ball comes into contact with the roller wheel 60 which provides a gripping action to the ball whereupon at the break over point, the ball is propelled, the roller wheel 60 rotates counter-clockwise and a spin is imparted to the ball as it is propelled. It is contemplated that, if desired, resistance might be added to the free-spinning roller wheel 60 to alter the spin characteristics imparted to the ball. The inventive ball control device 30 is not limited by any materials of construction, including the roller wheel 60 and ridges 66 which may be made of any suitable materials such as metals, plastics, composites, ceramics, rubber or elastomeric materials.

The ball advances along the channel 34 on a standard line of travel that corresponds generally to the longitudinal axis of the device 30, i.e. along the line of the central rib 32. A wider variety of pitches can be provided by mounting a means for partially obstructing the standard line of travel and for tipping the ball so that it thereafter advances along a non-standard line of travel. One such means is shown in FIGS. 2–3 and comprises an oblong obstacle 68 positioned at one side of the channel 34. The oblong obstacle 68 is held in position by a bracket 70 affixed to the central rib 32 and by a curved arm 72. As the ball rolls on the surface of the channel 34 toward the terminal end of the device 30 along the standard line of travel it contacts the oblong obstacle 68 and is tipped off-center. It thereafter wobbles as it rolls further toward the terminal end of the device 30 advancing along the channel 34 and engaging the spin actuator 52 on a non-standard line of travel, meaning any line of travel not corresponding to the line of travel taken by the ball when it has an unimpeaded path to the terminal end of the device 30.

The present invention thus provides the practicing hitter or fielder with the ability to simulate a real game situation. Each pitched ball has a different look, as the type of spin imparted to the ball and the resulting trajectory is dependent upon the alignment of the ball seams as the ball contacts the spin actuator 52 and on the line of travel taken by the ball to the spin actuator 52. The device 30 may be readily attached to the throw arm of any machine, adding a valuable feature to existing machines. For baseball, hitting and fielding skills and hand/eye coordination may be improved as the player does not know what type of pitch is forthcoming and must practice with increased concentration and focus.

While the invention has been described with a certain degree of particularity, it is manifest that many changes may be made without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A ball control device for combination with a ball tossing machine of the type having a rotating throw arm for propelling a ball, said ball control device comprising:

a proximal end for mounting to said throw arm, a terminal end, and a longitudinal channel therebetween, said longitudinal channel defining a ball receiving area and ball pathway, whereby when in operative relation with said throw arm and in combination with said ball tossing machine said channel receives said ball and, as said throw arm rotates to a break over point, said ball advances along said channel toward said terminal end whereupon said ball is propelled; and a wheel element mounted at said terminal end in a ball contacting position for momentarily engaging a surface portion of said ball when said throw arm reaches said break over point, thereby imparting a spin to said ball as said ball is propelled from said device.

2. The ball control device according to claim 1, wherein said wheel element comprises a free-spinning roller wheel mounted on an axle and supported by a roller wheel support plate.

3. The ball control device according to claim 2, wherein the surface of said roller wheel is provided with a plurality of transverse ridges.

4. A ball control device for combination with a ball tossing machine of the type having a rotating throw arm for propelling a ball, said ball control device comprising:

a proximal end for mounting to said throw arm, a terminal end, and a longitudinal channel therebetween, said longitudinal channel defining a ball receiving area and ball pathway, whereby when in operative relation with said throw arm and in combination with said ball tossing machine said channel receives said ball and, as said throw arm rotates to a break over point, said ball advances along said channel on a standard line of travel toward said terminal end whereupon said ball is propelled;

a spin actuator mounted at said terminal end in a ball contacting position for momentarily engaging a surface portion of said ball when said throw arm reaches said break over point, thereby imparting a spin to said ball as said ball is propelled from said device; and means mounted along said longitudinal channel for partially obstructing said standard line of travel and for tipping said ball as it advances along said standard line, causing said ball to thereafter advance along said channel and to engage said spin actuator on a non-standard line of travel.

5. The ball control device according to claim 4, wherein said spin actuator comprises a free-spinning roller wheel mounted on an axle and supported by a roller support plate.

6. The ball control device according to claim 5, wherein the surface of said roller wheel is provided with a plurality of transverse ridges.

7. The ball control device according to claim 4, wherein said means for partially obstructing said standard line of travel and for tipping said ball comprises an oblong obstacle positioned at one side of said longitudinal channel.

8. A ball tossing machine comprising a rotating throw arm and a ball control device, said ball control device comprising:

a proximal end for mounting to said throw arm, a terminal end, and a longitudinal channel therebetween, said longitudinal channel defining a ball receiving area and ball pathway, whereby when in operative relation with said throw arm and in combination with said ball tossing machine said channel receives said ball and, as said throw arm rotates to a break over point, said ball advances along said channel toward said terminal end whereupon said ball is propelled; and a wheel element mounted at said terminal end in a ball contacting position for momentarily engaging a surface portion of said ball when said throw arm reaches said break over point, thereby imparting a spin to said ball as said ball is propelled from said device.

* * * * *